US007017671B2

(12) United States Patent
Williford

(10) Patent No.: US 7,017,671 B2
(45) Date of Patent: Mar. 28, 2006

(54) MUD SAVER VALVE

(76) Inventor: Gary M. Williford, 1529 Gardenia Dr., Houston, TX (US) 77018

( * ) Notice: Subject to any disclaimer, the term of this patent is extended or adjusted under 35 U.S.C. 154(b) by 103 days.

(21) Appl. No.: 10/788,497

(22) Filed: Feb. 27, 2004

(65) Prior Publication Data

US 2005/0189144 A1 Sep. 1, 2005

(51) Int. Cl.
*E21B 21/10* (2006.01)

(52) U.S. Cl. ..... 166/386; 166/108; 166/321; 166/325; 175/318

(58) Field of Classification Search ..... None

See application file for complete search history.

(56) References Cited

U.S. PATENT DOCUMENTS 3,698,411 A * 10/1972 Garrett ..... 137/71
4,768,598 A * 9/1988 Reinhardt ..... 175/26
6,487,960 B1 * 12/2002 Chatufale ..... 92/165 R
2001/0042625 A1 * 11/2001 Appleton ..... 166/379

* cited by examiner

*Primary Examiner*—Zakiya Walker
(74) *Attorney, Agent, or Firm*—The Matthews Firm

(57) ABSTRACT

A mud saver valve being operable in conjunction with a top drive unit to retain mud in the top drive unit when a tubular is disconnected therefrom. The valve utilizes a spring-loaded piston to control the flow of mud or other fluid onto the work area and environment while the top drive unit is being connected to the new tubular and re-connected to the original tubular string. The valve further comprises multiple check valves for evaluating as well as monitoring wellbore pressure. The valves provides for full bore flow passages for the mud or fluid being pumped into a tubular fluidly connected to the top drive.

18 Claims, 7 Drawing Sheets

MUD SAVER VALVE

FIELD OF THE INVENTION

This invention relates to apparatuses for preventing the loss of drilling mud or other fluids when a top drive unit or kelly are disconnected from a tubular string in order to add additional tubulars to the tubular string or to perform other tasks.

BRIEF BACKGROUND

When tubulars and/or tubular strings are lowered into or raised out of a wellbore, including, but not limited to, drilling the wellbore, it is common practice, particularly in the oil and gas field, for the tubulars and/or tubular strings to be filled with a fluid or mud. The fluid is typically pumped into the top of the tubular after it has been connected to the tubular string below it and/or as it is being lowered into a wellbore. As the next tubular joint is added to the tubular string, the fluid connection is typically disconnected from the tubular string to allow the next tubular or tubular joint to be connected to the tubular string. When the fluid connection is disconnected, there should preferably to be a valve in place to retain this fluid and prevent it from flowing out onto the work area and environment. The advantages of using such a valve are well known and include saved mud cost, decreased chances of pollution, and increased safety to rig personnel.

In the drilling operation, these valves are typically inserted between the kelly and the tubular string. Typical valves of the mud retaining type are illustrated in the following patents:

| Patentee | U.S. Pat. No. |
|---|---|
| Taylor | 3,331,385 |
| Garrett | 3,698,411 |
| Litchfield, et al | 3,738,436 |
| Williamson | 3,965,980 |
| Liljestrand | 3,967,679 |

All of the above listed patents include a downwardly opening spring loaded poppet type valve enclosed in a body having at least two parts. These two extra pieces in the drill string replace a conventional single piece kelly saver sub, which functions to reduce wear on the kelly pin. The two-part body is generally longer than a standard kelly saver sub and consequently increases the length of the string which must be handled at the rig. In most oil and gas drilling and/or production operations, it is mandatory that a lower manually operated kelly inside blowout prevention ("IBOP") safety valve be included in the string at all times, which is another addition to the length of the string which must be handled. Thus, on most oil and gas drilling and/or production rigs, where the height of the derrick or mast is usually limited, it may be impossible to include a mud retaining type valve with a two-part body.

An additional disadvantage inherent in mud retaining valves with two-part bodies is that the pin of the lower body member replaces the pin of the kelly saver sub and is therefore subject to tremendous wear. This wear limits the longevity of the pin and therefore the longevity of the valve. A solution to this problem has been to insert an additional short sub below the lower body member. However, this solution is not entirely satisfactory because it adds still more length to the string.

A further disadvantage of heretofore existing mud retaining valves is in the fact that none of them include means for adjusting the force with which their respective closure members are driven upwardly. The force may be insufficient to close the valve when heavy muds are used.

U.S. Pat. No. 4,128,108 to Bill Parker, et. al. is yet another example of a mud saver valve, and shows in its FIGS. 2 and 3 a mud saver valve which, when the mud pumps are on, mud can flow through the interior of the valve, but which closes when the mud pumps are turned off based upon a spring-loaded closure mechanism which does not have the spring strength to close the valve until the mud pumps are turned off. As with this mud saver valve and with the other ones above referenced, once the mud pumps are turned off, the valve closes and the mud saver valve provides its desired purpose, that of preventing the mud from being spilled out onto the rig floor when the tubular string is being broken down.

The valves disclosed above are unusable in top drive units. In a top drive unit, space below the top drive and above the tubular string is at a premium and must be kept to a minimum. Typically, the conventional top drive comprises two IBOP valve subs. The upper IBOP sub typically contains a remote controlled shut-off valve and the lower IBOP sub typically contains a manual shut-off valve. These valves are typically utilized to prevent damage from wellbore kicks or pressure surges. However, neither of these IBOP sub valves are automatic. Thus, these valves cannot automatically allow fluid or mud flow into the tubulars and/or tubular string, when the mud pumps are running, or prevent flow through the top drive, when the mud pumps are de-energized or shut down. Further, these IBOP sub valves do not provide a simple monitoring of the pressure in the tubular string connected to the top drive. Further, constant use of the IBOP valves as mudsaver valves may cause premature wear requiring costly repair or replacement; in a worst case, the IBOP valves may not be operable when needed to control the wellbore pressure.

BRIEF DESCRIPTION OF THE DRAWINGS

FIG. 1E is an illustration of an adapter for the tool illustrated in FIG. 1D.

FIG. 3A is an illustration of a special spanner type tool which may be used for the installation and removal of the retaining ring illustrated in FIG. 3.

DETAILED DESCRIPTION OF EMBODIMENTS

Figure 1:
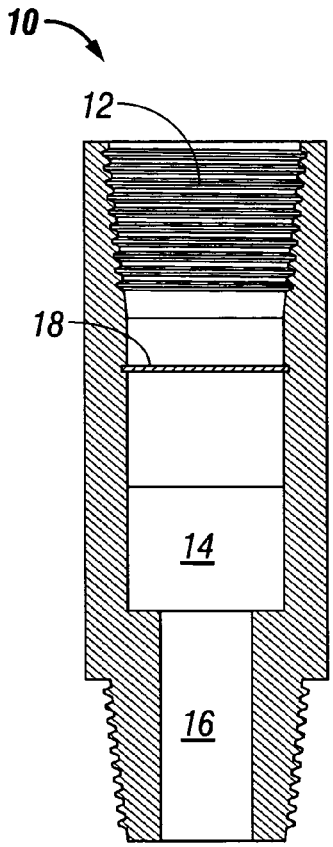
FIG. 1 is an illustration of a cutaway view of an improved mud saver valve sub.
Figure 2:
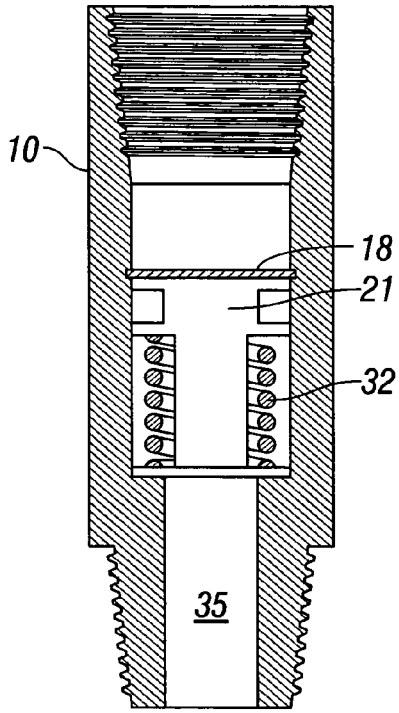
FIG. 2 is an illustration of a cutaway view of the improved mud saver valve sub, illustrated in FIG. 1, further illustrating a mud saver valve therein.

Referring now to FIG. 1 there is illustrated a valve sub 10 having a through bore 16 and an upper end with a box connection 12 which is preferably threaded. Further illustrated is the valve pocket 14 wherein preferably is inserted the mud saver valve 21 (FIG. 2). The valve 21 is preferably retained by a conventional snap ring (not shown) which preferably fits in the retaining groove 18. It should be appreciated that the retainer is not limited to a conventional snap ring but can be a variety of retaining devices including, but not limited to, springs, retaining pins, retaining rings, shear pin, shear screws, screws, rivets, bolts, and the like. Preferably, the valve 21 is retained in a manner to secure the valve body against wellbore pressure kicks while still allowing the removal of the valve 21 without destroying the valve sub 10. The lower end of the valve sub 10, preferably, comprises a threaded pin end connection 11. It should be appreciated that the upper 12 and lower 11 valve sub connections are not limited to a box and pin connection respectively. The connections can be reversed or can comprise other connection methods as necessitated by the tubulars, tools or other equipment that may be attached either above or below the valve sub 10. FIG. 2 illustrates the valve 21 positioned within the valve sub 10. It should be appreciated, by those skilled in the art, that the valve sub 10 is preferably attached at the threaded pin end connection 11 to a tubular and/or tubular string. It should be further appreciated that a tubular is preferably a drill pipe but can also include, but not be limited to, pipe, casing, tubing, other oilfield tools, equipment and tubulars, and the like and thus a tubular string is preferably such multiple tubulars connected together.

Figure 1A:
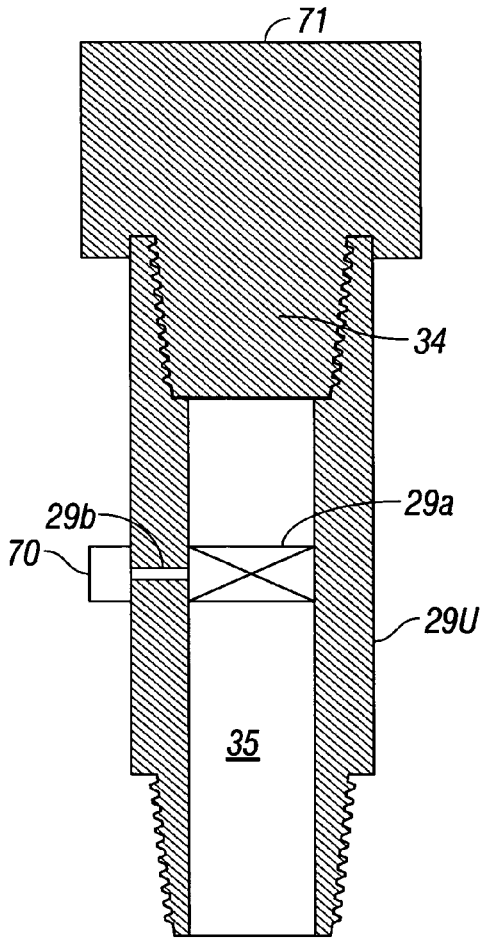
FIG. 1A is an illustration of a conventional upper IBOP in a cutaway view.
Figure 1B:
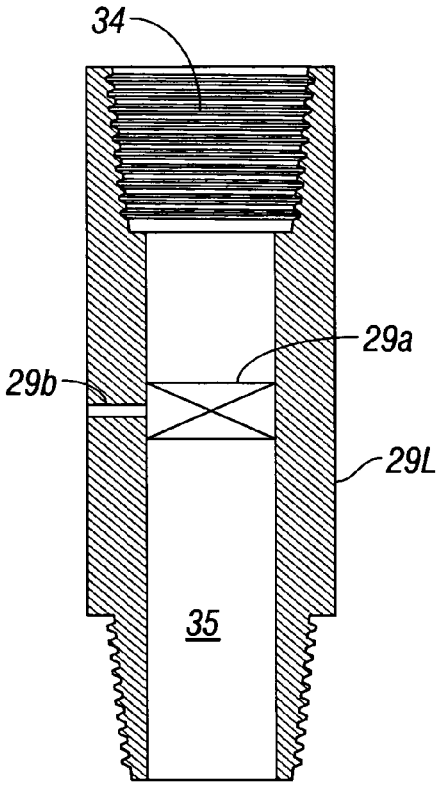
FIG. 1B is an illustration of a conventional lower IBOP in a cutaway view.
Figure 1C:
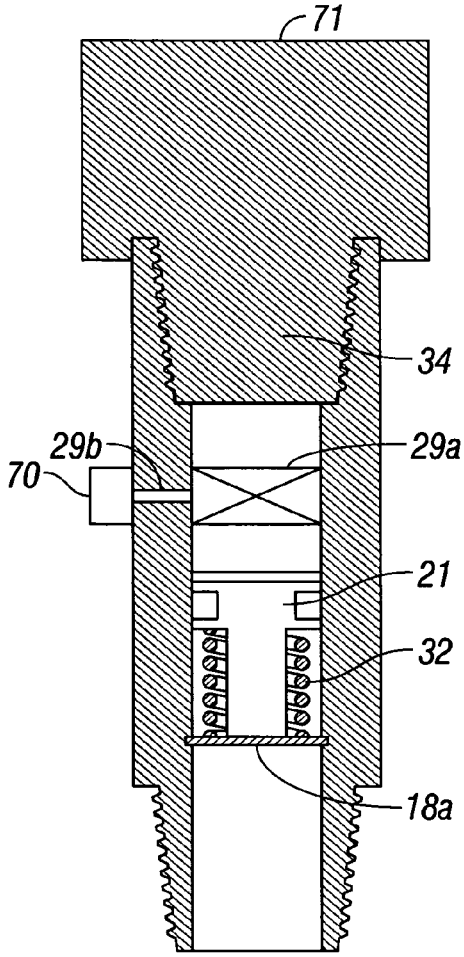
FIG. 1C is an illustration of a conventional upper IBOP in a cutaway view further illustrating a mud saver valve therein.

FIG. 1A illustrates a conventional upper IBOP 29U. It should be appreciated that FIGS. 1A–1C are for clarification purposes only and are not intended to be a detailed depiction of IBOP's but more for aiding in the description of the interaction of the present apparatus with such conventional IBOP's. FIG. 1B illustrates a conventional lower IBOP 29L. For simplicity, both IBOP's are shown with a conventional internal block valve 29*a* and corresponding stem 29*b*. The upper IBOP 29U is typically configured for remote operation and is illustrated herein with a conventional remote controlled operator 70. The upper IBOP 29U is typically attached to a conventional top drive 71. Typically, both the upper 29U and the lower 29L IBOP each have a box end 34 and pin end 35. It should be appreciated that the end connections of the IBOP's can vary and should not be viewed as a limitation of the present apparatus.

FIG. 1C illustrates the placement of the valve 21 within an upper IBOP 29U. Preferably, the valve 21 is inserted through the bottom or pin end 35 of the upper IBOP 29U. However, with different configurations, of an upper IBOP, the valve 21 may also be inserted in the top of an IBOP. Preferably, the valve 21 is retained within the upper IBOP 29U by a suitable retainer in retaining groove 18*a*. As with the retainer for the valve 21 within the valve sub 10, it should be appreciated that the method of retention can include, but is not limited to, snap rings, springs, retaining pins, retaining rings, shear pin, shear screws, screws, rivets, bolts, and the like. It should be further appreciated, by those in the art, that it would preferably be more convenient to retain the bottom of the valve 21 as opposed to the top as in the valve sub 10. However, either place of retention could satisfy the need for detachably retaining the valve 21 within the upper IBOP 29U.

It should be appreciated that the valve 21 is not limited to only placement within valve sub 10 or within the upper IBOP 29U. Valve sub 10 can be installed below a conventional upper IBOP 29U and above a conventional lower IBOP 29L. In such an embodiment, upper connection 12 will preferably be threadably connected to the lower end of the upper IBOP 29U and lower connection 11 would preferably be threadably connected to the lower IBOP 29L. It should further be appreciated that in order to save available vertical length space, the valve sub 10 and the valve 21 may replace the upper IBOP 29U. Thus, only the lower IBOP 29L would be utilized. Still further, the valve 21 may be placed directly into the top or bottom of an upper IBOP 29U which has been modified to enclose the valve 21 (FIG. 1C).

Figure 1D:
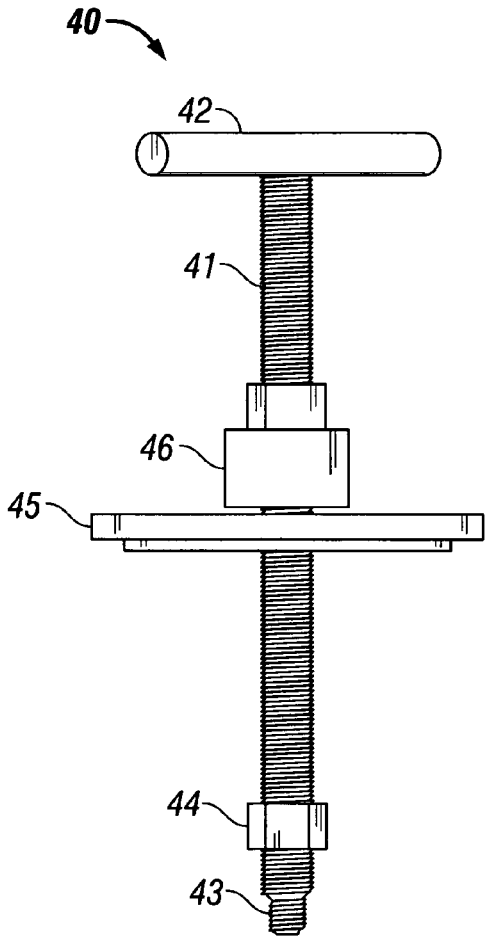
FIG. 1D is an illustration of a tool for removing/installing a mud saver valve.

The upper 29U and lower 29L IBOP's allow the insertion of certain tools or wireline equipment into the tubular string. Should a need arise, for such insertion, the valve 21 will preferably be removed. If the valve 21 is positioned within the valve sub 10, then preferably the valve sub will be removed. If the valve 21 is carried within the upper IBOP 29U, the valve 21 is preferably removed using a special tool 40 (FIG. 1D).

The special valve removal tool 40 (FIG. 1D) preferably comprises an all thread shaft 41 having a "T" handle 42, at one end and a reduced threaded portion 43 on the end opposite of the "T" handle 42 which is preferably made up into the top connection 26 (FIGS. 4 and 8) or into a removal tool adapter 47. It should be appreciated that the "T" handle 42 is preferably not for turning the tool, other than for threadedly engaging the valve removal tool 40. The preferred function, of the "T" handle 42 is to aid in maintaining physical control of the valve 21 during installation or removal particularly when installing or removing the valve 21 from a suspended sub or IBOP.

Figure 3:
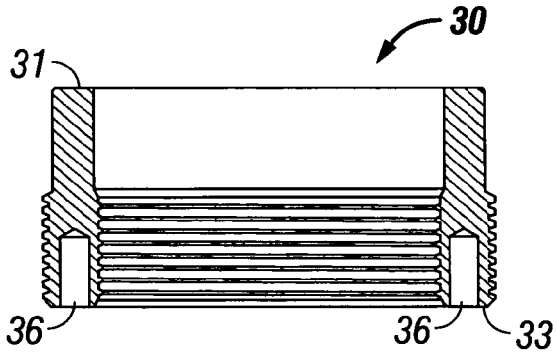
FIG. 3 is an illustration of a cutaway view of a mud saver valve retaining ring.

When used, the removal tool adapter 47 is preferably threadedly attached to the internal threads 37 of the retaining ring 30 (FIG. 3). FIG. 1E illustrates the removal tool adapter 47. Preferably, the removal tool adapter 47 will comprise an external threaded area 48 which is adapted to threadably connect to the internal threads 37 of the retaining ring 30. Further, the removal tool adapter includes an internally threaded connection 49 which can threadedly mate with the reduced threaded portion 43 of the special valve removal tool 40. It should be appreciated that the adapter 47 is utilized when removing the valve 21 from the bottom end of a sub or IBOP.

Referring again to FIG. 1D, it is illustrated that preferably the tool 40 further comprises a pull plate 45 and a hex bushing 46, which when preferably turned clockwise, applies pressure against the pull plate 45 causing the valve 21 to be removed from the valve sub 10 or the upper IBOP 29U. It should be appreciated that, although the preferred design of the tool 40 is illustrated, other variations of the tool 40 could be envisioned with the goal of removing the valve 21 and are within the scope of this invention. An example, which is not intended as limiting, the pull plate 45 may comprise threads on the external circumference (not shown) which may engage the box threads of a sub or IBOP to aid in the valve 21 installation or removal. It should further be appreciated that the use of the tool 40 is not intended to only be limited for use in conjunction with the upper IBOP 29U or the valve sub 10 but can be utilized, as is or somewhat modified, to remove the valve 21 from substantially all installations of the valve 21. For example, but not in a limiting sense, a nut 44 may be fixedly attached at some predetermined distance from the reduced threaded portion 43. The nut 44 may allow for the tool 40 to be threadedly locked onto the valve 21 at connection 26 (FIGS. 4 and 8) or to the removal tool adapter 47 at connection 49. Still further, it should be appreciated that the tool 40 can be used to remove the valve 21 from either the top or the bottom of a valve sub or an IBOP. Preferably, the removal tool adapter 47 is used when removing the valve 21 from the bottom of a valve sub or IBOP. It should be noted that although the preferable use of the tool 40, with or without the adapter 47, is to remove the entire valve 21, it is envisioned that an adaptation of the tool to only remove parts of the valve 21 is within the scope of this invention.

It is also envisioned that the valve sub 10, with the valve 21, may be used between a conventional kelly and the tubular string being lowered into the wellbore. The preferable advantage, is that the valve sub 10 will provide a much more compact design primarily by conserving the valuable vertical space on the rig described herein above.

Figure 11:
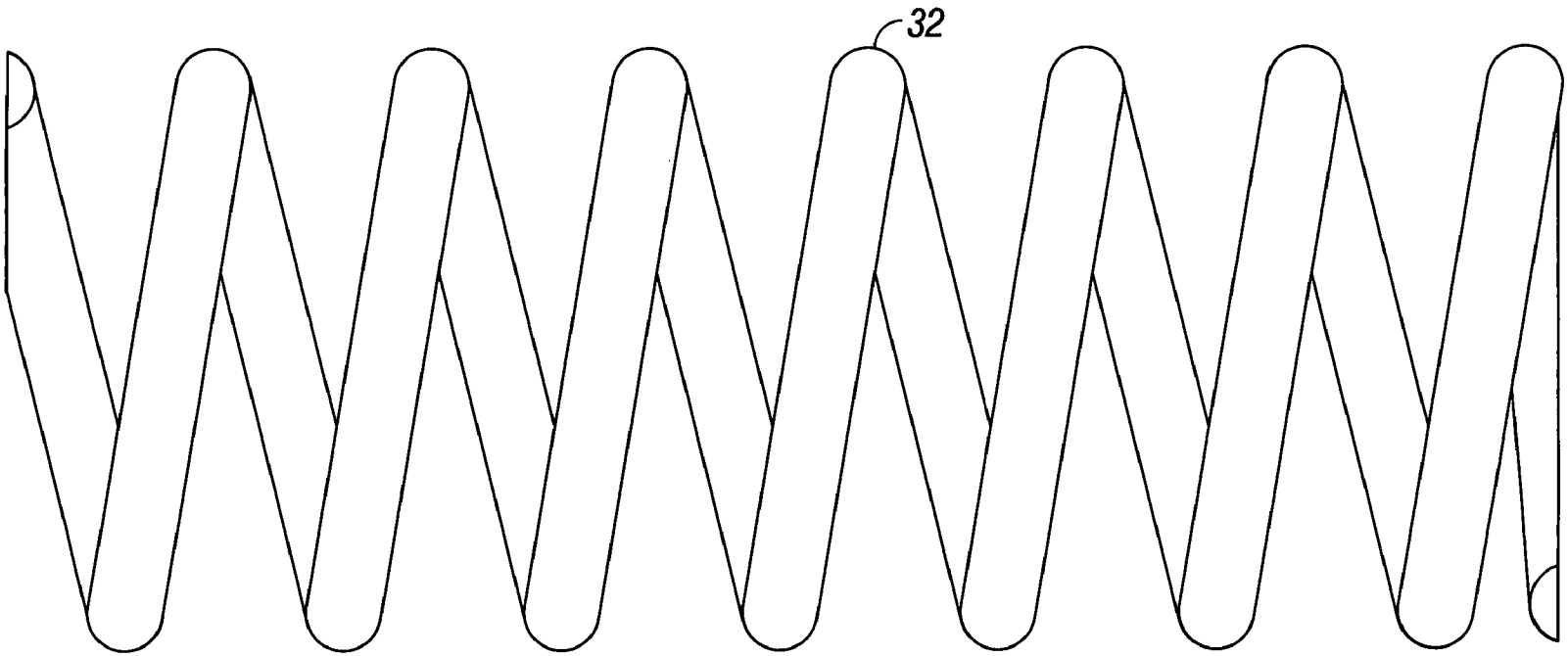
FIG. 11 is an illustration of a spring for the mud saver valve and piston.

FIG. 3 illustrates the retaining ring 30 which preferably fits in the bottom of the valve body 20 (FIG. 4) in the bottom threaded area 22. Preferably, a set screw 90 may be used to prevent the retaining ring 30 from rotating after installation. It should be appreciated that although a set screw is preferred, a variety of fasteners including, but not limited to, rivets, shear pins, shear screws, bolts, and the like may be used. The upper surface 31 may preferably contact spring 32 (FIG. 11). It should be appreciated that when desired upper surface 31 may not directly contact the spring 32 and may instead include a type of spacer, washer, gasket, or similar element between the upper surface 31 and the spring 32. Further, the upper surface 31, may be coated or treated so as to have a harder surface for contact with the spring 32 in order to avoid undesired wear between the upper surface 31 and the spring 32. Preferably, after installation or assembly, the bottom surface 33, of the retaining ring 30, will not protrude out beyond the bottom surface 23 of the valve body 20. The retaining ring will preferably perform at least two functions including, but not limited to, retaining the spring 32 within the valve body 20 and also compressing the spring 32 such that the force of the spring 32 against the piston 50 (FIG. 9) urges the piston 50 in an axial direction toward the top of the valve body 20. (See FIG. 2 illustrating a general arrangement of the valve 21). The above will be more fully described herein below.

Figure 9:
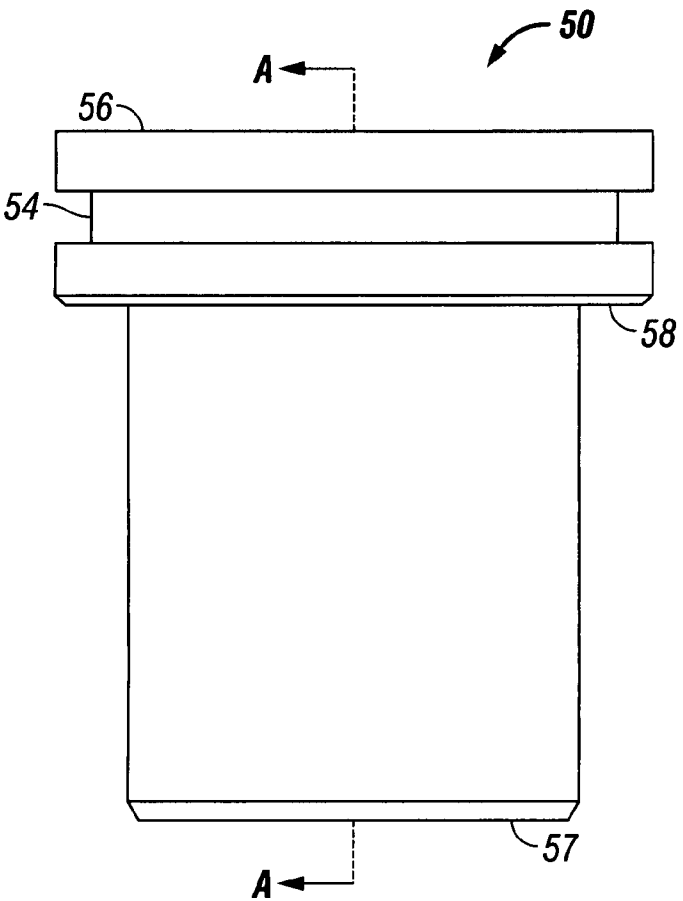
FIG. 9 is an illustration of a side view of the mud saver valve piston.

Still referring primarily to FIG. 3 and secondarily to FIG. 3A, the retaining ring 30 can be threaded in and/or removed, from the valve body 20 utilizing a special spanner type tool or wrench 62. Such special spanner type tool 62 may be substantially tubular or another shape such that the pins 65 would preferably be inserted into holes 36 located on the bottom surface 33. Preferably, the special spanner type tool 62 is turned clockwise while pressure is applied to compress the spring 32 (FIG. 11) to aid in installing the retaining ring 30. Preferably, the retaining ring 30 is inserted, into the valve body 20, a certain pre-determined distance to create a pre-calculated compression on the spring 32; thus preferably providing the required spring force against the piston 50 (FIG. 9). To remove the retaining ring 30, the special spanner tool 62 is preferably rotated in a counter clockwise direction while the tool 62 preferably aids in controlling the de-compression of the spring 32. It should be appreciated, by those in the art, that the dimensions and number of the removal holes 36 are dependant on the dimensions of the retaining ring 30 and can be increased if so desired and/or required. It should be understood that directions of rotation, disclosed herein, are the preferred directions of rotation and should not be viewed as a limitation on the operations of the present apparatus nor the scope of the invention. It should be noted that the pressure, to be applied to maintain the spring pressure during the installation or removal of the retaining ring 30 may be preferably attained through the use of a conventional hydraulic cylinder (not shown). In such an embodiment, the conventional hydraulic cylinder would preferably exert pressure on the special spanner tool 62, towards the spring. The hydraulic cylinder would preferably be in communication with shaft 64. This pressure, would preferably counter the spring force exerted on the retaining ring 30 and thus allow the retaining ring to be rotated. The rotation is preferably supplied through the special spanner tool 40 by inserting a pin, rod, stem, or the like, into the rotation holes 63 of the special spanner tool 62, or by the use of a wrench across the flats 66. It should be appreciated that the configuration of the special wrench 62 can vary and that it is deemed within the spirit of this invention. Examples of such may include, but are not necessarily limited to, the location, shape, and number of pins 65, the length and shape of shaft 64, the location and type of wrench connection 66, and the location, size and shape of the rotational holes 63.

Figure 4:
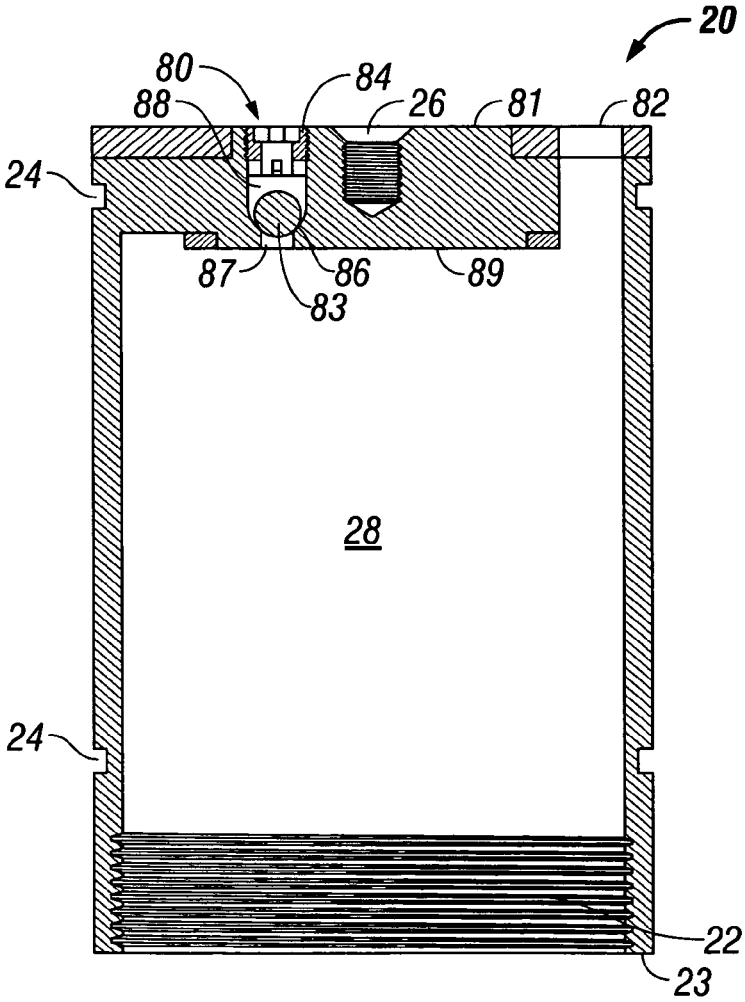
FIG. 4 is an illustration of a cutaway view of the mud saver valve body.

Referring now to FIG. 4, a cutaway view of the valve body 20 is illustrated. Preferably, grooves 24 are provided for conventional seals, such as, but not limited to, o-rings (not shown). The seals prevent fluid or pressure leakage around the valve body 20 when it is installed in a sub, such as valves sub 10 or in the upper IBOP 29U. Preferably, the upper surface 81 comprises ball check valves 80 and flow slots 82 which will be described in more detail herein below. The upper surface 81 will preferably further comprise a threaded female connection 26. Connection 26 is preferably used to raise and lower the valve 21. It should be understood that lifting and lowering of the valve includes the installation and removal of the valve. It should further be understood that although the preferred configuration of connection 26 is having female threads, any variety of connections could be used to such as but not limited to eye bolts, hooks, internal lift slots, internal lugs, and the like and that such modifications would also include modifications of any installation and removal tools such as the removal tool 40 (FIG. 1D).

FIG. 4 further illustrates a cutaway view of check valve 80, whose function will be described more fully herein below. The check valve 80 preferably includes, but is not limited to, a ball 83, a ball or valve seat 86, and a ball retainer 84. Preferably, the check valve 80 has a throughbore 87 which passes through the ball retainer 84 (FIG. 7) and the upper surface 81 of the valve body 20. The check valve 80 preferably seals against flow moving from the upper surface 81 toward the lower surface 23.

Figure 5:
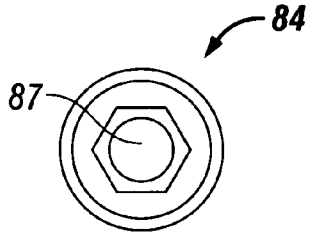
FIG. 5 is an illustration of a top view of the mud saver valve check valve retainer nut.
Figure 6:
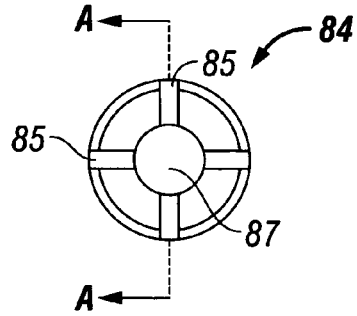
FIG. 6 is an illustration of a bottom view of the mud saver valve check valve retainer nut illustrated in FIG. 5.
Figure 7:
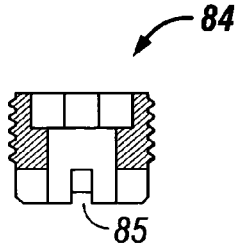
FIG. 7 is an illustration of a cutaway view of the mud saver valve check valve retainer nut illustrated in FIG. 5.

FIGS. 5, 6, and 7 illustrate several views of the ball retainer 84 of the check valve 80. The check valve seat 86 is preferably integral to the valve body upper end 81. The ball 83 is retained in the check valve 80 by the ball retainer 84. FIG. 5 illustrates a top view of the ball retainer 84 and further illustrates the preferred internal hex drive for removal and installation. FIG. 6 illustrates a bottom view of the ball retainer 84 and further illustrates flow channels 85. The flow channels 85 preferably allow flow in the upward direction to pass through the ball retainer throughbore 87. It should be appreciated that the flow channels 85 are provided so as to prevent the ball 83 from plugging the throughbore 87 as it passes through the ball retainer 84. FIG. 7 illustrates a side view of the ball retainer 84.

It should be understood that the preferred purpose of the check valve 80 is to prevent flow in one direction. Therefore, many varieties of such a check valve can be envisioned within the spirit of this invention. Such variations may include, but are not limited to, a drive configuration, for the ball retainer 84, that is not hexagonal, a shaped plug as opposed to as ball, a one piece pocket type valve that can be inserted in the valve body upper end 81, a multi-piece check valve, an external check valve, or a bypass which might eliminate the need for the check valve.

Figure 8:
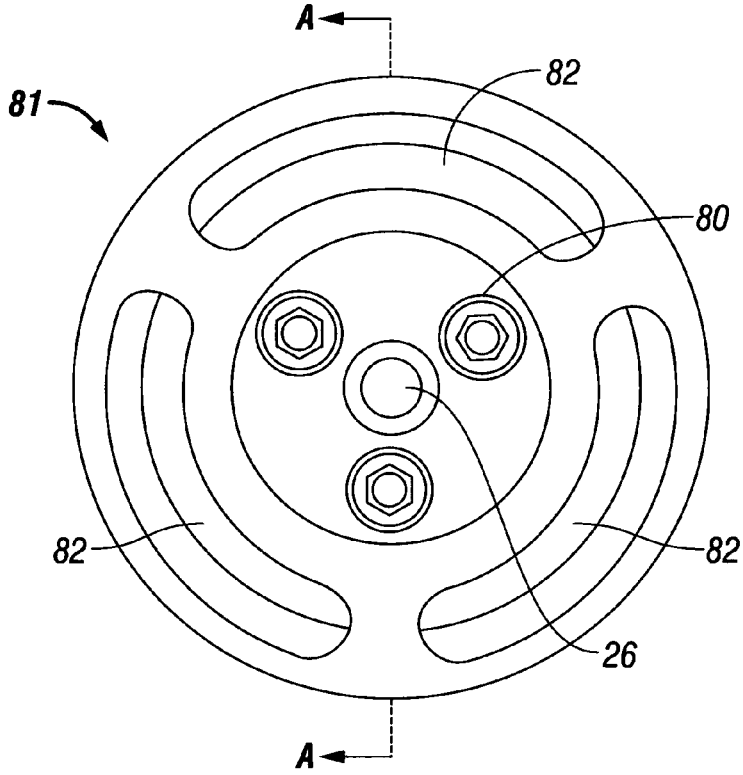
FIG. 8 is an illustration of a top view of the mud saver valve.

FIG. 8 illustrates a top view of the upper end 81 of the valve body 20. This view illustrates further detail of the connection 26, the check valves 80 and flow slots 82. As can be seen in FIG. 8, the preferred number of check valves 80 is three. It should be appreciated that this arrangement provides advantages such as a redundancy feature wherein a check valve 80 can become plugged from the fluid passing therethrough or the ball 83 may deform in such a matter as to plug the throughbore 87 passing through the ball retainer 84. A further advantage may be to allow required flow rates or flow volumes to pass through the multiple check valves, particularly if one of the check valves is blocked or otherwise prevents flow. It should be understood that the preferred purpose for the through bore 87 is to allow fluids to pass from portions of the wellbore below the mudsaver valve 21 up through the piston bore 52 and out through the throughbore 87 up to the earth's surface to allow the wellbore pressure to be measured. Therefore, it should be appreciated that the availability of three such passages preferably insures that such fluids will be accessible, from the wellbore, even give a situation wherein one passage becomes blocked.

Figure 10:
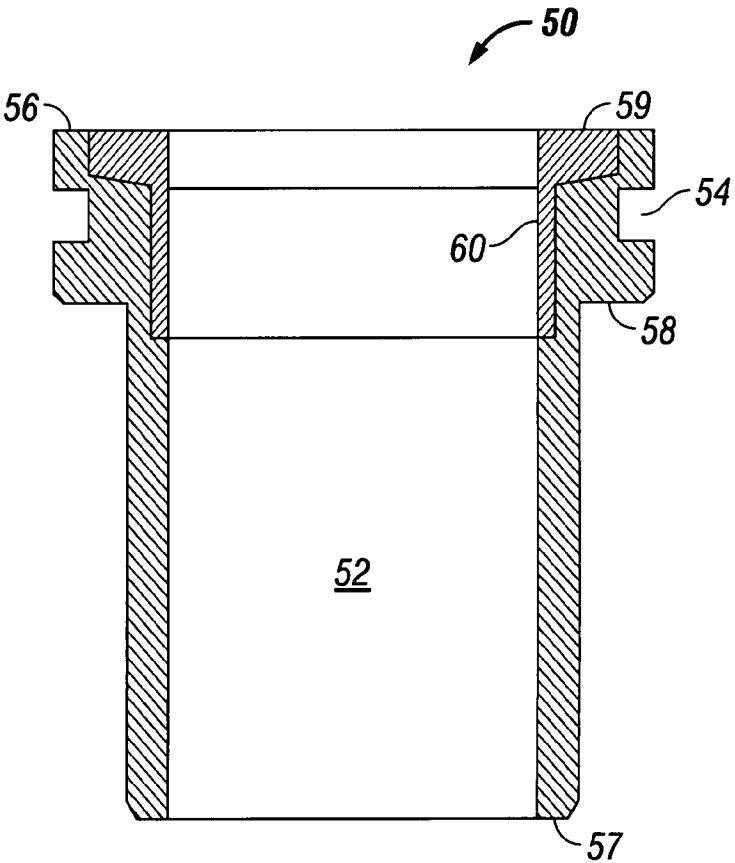
FIG. 10 is an illustration of a cut away view of the mud saver valve piston.

FIG. 9 is a side view illustration of the valve piston 50. FIG. 10 illustrates a cutaway view of the piston 50. Referring to FIGS. 9 and 10, the piston has a through bore 52 which preferably allows the flow of fluid or mud into and out of the wellbore. The piston 50 further comprises at least one seal groove 54. The seal groove 54, is preferably fitted with seal, such as, but not limited to, an o-ring (not shown). The o-ring preferably seals against the valve body internal cavity 28 (FIG. 4). It should be appreciated that the specific type of seal is dependant on the fluid environment and thus should not be seen as being limited only to an o-ring, an elastomeric seal, or a single seal. The piston 50, preferably, still further comprises an upper surface 56, a lower surface 57, and a spring contact surface 58.

Referring still to FIG. 10, the piston 50 may preferably comprise an erosion and/or corrosion resistant insert or inserts. In one embodiment, a first insert 59 may form a part of the upper surface 56 and an upper portion of the piston 50 bore wall. A second insert 60 may be fixedly attached, forming a portion of the piston bore 52, below the first insert 59. It should be appreciated that these inserts are preferably of a hard metallic material such as, but not limited to, tungsten carbide. Further, the first 59 and second 60 inserts may be combined as a single insert. Still further, the insert or inserts may be attached by welding, may be threaded into the upper piston bore, or attached by another industry acceptable method. It should also be further appreciated that the piston 50 could be entirely made or cast of an erosion resistant material or that the hard metal surface could be deposited onto the piston by welding, spraying, coating, or the like; thereby eliminating the need for the inserts 59, 60. It should be understood, by those in the art, that the lower surface 89, of the upper end 81 of the valve body 20 (FIG. 4), may also be coated with a hard surface, such as, but not limited to, tungsten carbide. The preferred purpose of harder metallic surface is to prevent pre-mature failure of the piston and/or the corresponding valve body contact surface 89 due to excessive erosion from the fluid flow.

It should be appreciated that in order to allow the necessary flow, through the valve 21, the piston bore 52 must be sufficiently large to allow the necessary flow rate. Preferably, the piston bore 52 will have some pre-determined flow area or cross-sectional area. This cross-sectional area or flow area is preferably sized so that a pre-determined flow is allowed through the piston bore. This flow rate is, in turn, preferably based upon the necessary flow of fluid as required to be introduced into the tubular string attached downstream of the valve 21. To that end, the flow slots 82, of the upper surface 81, are preferably sized such that the total flow area or total cross-sectional area, of all of the flow slots 82, is at least equal to or greater than the flow area or cross-sectional area of the piston bore 52. It should be noted that the cross-sectional area, or flow area, of each slot 82 is preferably pre-determined before the flow slots 82 are manufactured. This will preferably insure that the sum of the flow slot 82 cross-sectional areas is greater than or substantially equal to the cross-sectional area of the piston bore 52. Thus, preferably there will be no substantial flow restriction or reduction, due to flow area reduction, caused by the installation of the valve 21.

It should be appreciated that the materials of construction, of the valve sub 10, the valve 21, and all of its parts are known in the industry and are preferably metallic with the possible exception of the seals. However, as described herein above, some of the metals are harder or are coated with a harder substance to resist erosion. The specific choice of materials is preferably dependant on the environment to resist erosive and corrosive attack and to resist deformation from pressure or contact, as well as for compatibility with parts that are in contact with each other.

For operation, the valve is assembled, in no particular order, but as described herein below. The check valve balls 83 are inserted into the ball cavity 88 (FIG. 4). The ball retainers 84 are preferably threaded into the ball cavity 88 above the check valve balls 83. The piston is fitted with the selected seal in the seal groove 54. The piston 50 is fitted inside the valve body cavity 28. The spring 32 (FIG. 6) is slidably mounted over the piston and inside the valve body cavity 28. Preferably, the spring 32 contacts the spring contact surface 58 of the piston 50 (FIG. 10). The retaining ring 30 is preferably threadedly engaged into the bottom threaded area 22 of the valve body 20. When fully threaded, the retaining ring will preferably compress the spring 32 some pre-determined amount. The compressed spring 32 will preferably exert a pre-calculated force on the piston 50. This pre-calculated force is preferably sufficient for the piston to block the flow of fluid or mud through the flow slots 82 when the mud pumps are de-energized but to allow the piston to be pushed down to allow flow through the flow slots 82 when the mud pumps are energized (i.e. the force of the mud pumps will preferably overcome the spring force exerted upwardly on the piston 50). Further, the fluid or mud, will maintain the balls 83 in contact with the check valve seat 86, whether the mud pumps are energized or de-energized, thus preventing any flow downward into the valve 21. It should be appreciated that the retaining ring 30 (FIG. 3) will preferably allow some adjustment of the spring 32. Thus, the retaining ring 30 can increase or decrease the spring force, exerted against the piston surface 58 (FIGS. 9 and 10) by being further engaged into the bottom threaded area 22 (FIG. 4) or disengaged out of the bottom threaded area 22.

The valve 21 is fitted with the selected seals in the seal grooves 24 (FIG. 4). If the valve 21 is inserted into the valve sub 10, then a suitable retainer is placed in retaining groove 18 (FIG. 1) to preferably retain the valve 21 within the valve sub. If the valve 21 is inserted into the upper IBOP 29U (FIG. 1C), the valve 21 is preferably inserted through the top or bottom end of the upper IBOP 29U. A suitable retainer is placed in a retaining groove 18*a* located in the bottom of the IBOP 29U to preferably retain the valve 21 within the upper IBOP 29U. It should be appreciated that when installed into the top of a sub or IBOP, the retainer may be above, below, or on both ends of the valve 21.

When the mud pumps or other fluid pumps are energized and/or operating, the mud or fluid will preferably flow through the flow slots 82. The pressure of the pumped fluid or mud will preferably overcome the spring force of spring 32 and urge the piston 50 in a downward direction. As the piston 50 moves away from contact with the piston sealing surface 89 (FIG. 4) the fluid or mud will flow through the piston bore 52 and into the tubular and into the wellbore. It should be understood that preferably there is no flow through the check valves 80 as the balls 83 are seated in the check valve seats 86.

Whenever the mud pumps are shut down or de-energized the spring pressure, exerted by spring 32, will preferably urge the piston 50 up against the piston contact surface 89 of the valve body 20. Thus, when the tubular joints are broken out, the mud is prevented from passing through the valve 21 preferably because of the seal formed between the piston contact surface 89, of the valve body 20, and the upper surface 59, 56 of the piston 50.

Although the mud saver valve 21, according to the present invention, is substantially shut in when the mud pumps are turned off or de-energized, the downhole pressure of the fluids can be measured by the fact that the balls 83, of the check valves 80, are moved off of their engagement with the seats 86 because there is no longer any pressure or flow, from the mud or fluid pumps, being exerted on the balls 83 in a downward direction. It should be appreciated that there is some pressure existing above the balls 83. However, this is typically only a static or head pressure that is a factor of line size and length directly above the check valves 80 on which gravity would act. Therefore, any significant pressure, in the wellbore, would over come this static pressure and move the balls 83 off of the seats 86. Thus, the fluid or mud can flow through the check valve flow bores 87 and the pressure and other parameters related to the downhole fluids can be measured. It should be appreciated that this action only allows flow in one direction. Therefore, if the wellbore pressure falls below the mud or fluid pressure above the check valves 80, the balls 83 will preferably return to the seats 86 and block any flow into the tubular below the valve 21.

From the foregoing, it can be seen that the present invention is one well adapted to seal against mud loss particularly in top drive assemblies and in conjunction with a conventional kelly while reducing axial length, allowing full fluid flow, and allowing measurements of desired parameters of the fluid or mud. It should be appreciated that certain embodiments of the present invention are not limited to specifically interact with top drive assemblies, they can likewise be adapted to kelly subs or set between the kelly sub and the tubular string as required or desired. It should be further appreciated that other advantages which are obvious and which are inherent to the present invention should not be limited by the examples presented in the foregoing descriptions. It will be understood that certain features and sub-combinations are of utility and may be employed without reference to other features and sub-combinations. This is contemplated by and is within the scope of the claims.

As many possible embodiments may be made of this invention without departing from the scope thereof, it is to be understood that all matter herein set forth or shown in the accompanying drawings is to be interpreted as illustrative and not in a limiting sense.

What is claimed is:

1. A fluid retaining apparatus, in a top drive assembly for retaining fluid in the top drive assembly when a tubular is disconnected therefrom, comprising:

a first tubular body adapted to be detachably mounted below said top drive;

a second tubular body adapted to be inserted into said first tubular body;

said second body being a downwardly extending closure member, said closure member having a bore extending axially therethrough;

an axially movable piston disposed within said second body, said piston having a flange extending radially outwardly therefrom into contact with said body, a passage having a cross-sectional area for the flow of fluid therethrough, said passage being substantially coaxial with said bore, and a top side;

said closure member having an upper side, wherein said upper side further comprises a plurality of flow passages, each having a cross-sectional area, such that the sum of the cross-sectional areas of said plurality of flow passages at least substantially equals the cross-sectional area of said passage within said piston;

said upper side further having a plurality of check valves to allow fluid to flow upwardly therethrough, wherein said flow allows downhole pressure to be detected;

a ring member engaging the lower end of said body and extending radially inwardly into contact with a compression spring; and said compression spring disposed within said body and compressed between said flange and said ring member, wherein said compression spring urging said piston axially upward blocking said plurality of flow passages, thereby preventing the downward flow of fluid therethrough.

2. The fluid retaining apparatus of claim 1, wherein said top side of said piston includes at least one replaceable wear member at the position where said piston contacts said closure member when said plurality of flow passages are blocked by said top side of said piston.

3. The fluid retaining apparatus of claim 1, wherein said ring member is adapted for movement between a plurality of axial positions within said body to vary the compression of said compression spring to compensate for varying fluid weights.

4. A fluid retaining apparatus, in a top drive assembly for retaining fluid in the top drive assembly when a tubular is disconnected therefrom, comprising:

a remote controlled shut-off valve mounted within a first tubular body, wherein said first tubular body is adapted to be detachably mounted below said top drive, wherein said remote controlled shut-off valve controls fluid flow into and out of said top drive;

said first tubular body having a top end and a bottom end;

a second tubular body adapted to be insertably mounted in said bottom end of said first tubular body;

said second body being a downwardly extending closure member, said closure member having a bore extending axially therethrough;

an axially movable piston disposed within said second body, said piston having a flange extending radially outwardly therefrom into contact with said body, a passage having a cross-sectional area for the flow of fluid therethrough, said passage being substantially coaxial with said bore, and a top side;

said closure member having an upper side, wherein said upper side further comprises a plurality of flow passages, each having a cross-sectional area, such that the sum of the cross-sectional areas of said plurality of flow passages at least substantially equals the cross-sectional area of said passage within said piston;

said upper side further having a plurality of check valves to allow fluid to flow upwardly therethrough, wherein said flow allows downhole pressure to be detected;

a ring member engaging the lower end of said body and extending radially inwardly into contact with a compression spring; and said compression spring disposed within said body and compressed between said flange and said ring member, wherein said compression spring urging said piston axially upward blocking said plurality of flow passages, thereby preventing the downward flow of fluid therethrough.

5. The fluid retaining apparatus of claim 4, further comprising:

a third tubular body detachably mounted below said fluid retaining apparatus; and a manually controlled shut-off valve mounted within said third tubular body, wherein said manually controlled shut-off valve further controls fluid flow into and out of said top drive.

6. A valve for retaining fluid in a kelly when a tubular is disconnected therefrom, comprising:

said kelly having an upper end and a lower end;

a first tubular body adapted to be detachably mounted to the lower end of said kelly;

a second tubular body adapted to be inserted into said first tubular body;

said second body being a downwardly extending closure member, said closure member having a bore extending axially therethrough;

an axially movable piston disposed within said second body, said piston having a flange extending radially outwardly therefrom into contact with said body, a passage having a cross-sectional area for the flow of fluid therethrough, said passage being substantially coaxial with said bore, and a top side;

said closure member having an upper side, wherein said upper side further comprises a plurality of flow passages, each having a cross-sectional area, such that the sum of the cross-sectional areas of said plurality of flow passages at least substantially equals the cross-sectional area of said passage within said piston;

said upper side further having a plurality of check valves to allow fluid to flow upwardly therethrough, wherein said flow allows downhole pressure to be detected;

a ring member engaging the lower end of said body and extending radially inwardly into contact with a compression spring; and said compression spring disposed within said body and compressed between said flange and said ring member, wherein said compression spring urging said piston axially upward blocking said plurality of flow passages, thereby preventing the downward flow of fluid therethrough.

7. A valve for retaining fluid in a rig assembly when a tubular is disconnected therefrom, comprising:

a tubular body being a downwardly extending closure member, said closure member having a bore extending axially therethrough;

an axially movable piston disposed within said body, said piston having a flange extending radially outwardly therefrom into contact with said body, a passage having a cross-sectional area for the flow of fluid therethrough, said passage being substantially coaxial with said bore, and a top side;

said closure member having an upper side, wherein said upper side further comprises a plurality of flow passages, each having a cross-sectional area, such that the sum of the cross-sectional areas of said plurality of flow passages at least substantially equals the cross-sectional area of said passage within said piston;

said upper side further having a plurality of check valves to allow fluid to flow upwardly therethrough, wherein said flow allows downhole pressure to be detected;

a ring member engaging the lower end of said body and extending radially inwardly into contact with a compression spring; and said compression spring disposed within said body and compressed between said flange and said ring member, wherein said compression spring urging said piston axially upward blocking said plurality of flow passages, thereby preventing the downward flow of fluid therethrough.

8. The valve of claim 7, further comprising:

a threaded rod having a first end and a second end, wherein said threaded rod is used for the installation and removal of said valve;

said first end being threaded and said second end being adapted to hold said threaded rod;

an internally threaded member threadedly engaged with said threaded rod; and an internally threaded circular plate, wherein said circular plate is threadedly engaged with said threaded rod and positioned between said first end and said internally threaded member, and wherein rotation of said internally threaded member causing the removal of said valve.

9. The valve of claim 7, wherein said retaining ring further comprises a threaded connection adapted to receive a removal tool adapter.

10. The removal tool adapter of claim 9, further comprising a circular plate defining an aperture therethrough, wherein the outside diameter of said circular plate is threaded and wherein said aperture is threaded.

11. A valve for retaining fluid in a rig assembly when a tubular is disconnected therefrom, comprising:

a cylinder having a first end and a second end, wherein said cylinder houses said valve;

a piston having a fluid passageway along its entire length, and having first and second ends, said first end of said piston having a first external diameter, and said second end of said piston having a second external diameter greater than said first external diameter, and a spring having first and second ends and sized to slide over the first end of said piston, but not over the second end of said piston; and an adjustment ring having external threads selected to be threaded into the second end of said cylinder and to bear against the first end of said spring, wherein said adjustment ring is threaded into the second end of said cylinder against one end of said spring.

12. The valve of claim 11, wherein said retaining ring further comprises a threaded connection adapted to receive a removal tool adapter.

13. The valve of claim 11, further comprising a plurality of check valves, wherein said check valves allow wellbore fluid to communicate with said rig assembly.

14. The valve of claim 11, wherein said spring urges said piston upwardly when a fluid pump is de-energized, and wherein said fluid pump is in fluid communication with said valve.

15. The valve of claim 14, wherein said spring is compressed downward when said fluid pump is energized, and wherein said piston is urged downward.

16. A method for retaining fluid, in a top drive unit, of a top drive assembly, when a tubular is disconnected therefrom, comprising:

detachably mounting a first tubular body below said top drive;

inserting a second tubular body into said first tubular body, wherein said second tubular body is a valve;

disposing an axially movable piston within said second tubular body, said piston having a flange extending radially outwardly therefrom into contact with said body, a passage having a cross-sectional area for the flow of fluid therethrough, and a top side;

providing said valve with a plurality of flow passages each having a cross-sectional area such that the sum of the cross-sectional areas of said plurality of flow passages at least substantially equals the cross-sectional area of said passage within said piston;

providing said valve with a plurality of check valves to allow fluid to flow upwardly therethrough, wherein said flow allows downhole pressure to be detected;

engaging a ring member in the lower end of said body, wherein said ring member extends radially inwardly into contact with said piston; and compressing a compression spring disposed within said body between said flange and said ring member;

urging said piston axially upward, by said compression spring, so that said plurality of flow passages is blocked by said top side of said piston, thereby preventing the downward flow of fluid therethrough.

17. The method of claim 16, further comprising the steps of:

de-energizing a fluid pump, wherein pump urges fluid through said top drive unit; and disconnecting said tubular from said top drive assembly.

18. The method of claim 17, wherein compression of spring is partly dependent on the relative axial position of said ring member when engaged in said lower end of said body.

* * * * *